United States Patent [19]

Crick

[11] 4,242,669

[45] Dec. 30, 1980

[54] PASSIVE INFRARED INTRUDER DETECTION SYSTEM

[75] Inventor: David W. Crick, West Molesey, England

[73] Assignee: B. A. Security Systems Limited, West Molesey, England

[21] Appl. No.: 35,844

[22] Filed: May 4, 1979

[51] Int. Cl.[3] ..... G08B 13/18; G08B 29/00

[52] U.S. Cl. ..... 340/567; 250/342; 340/506; 340/508; 340/512; 340/600

[58] Field of Search ..... 340/567, 600, 506, 508, 340/512; 250/342

[56] References Cited

U.S. PATENT DOCUMENTS

| | | | |
|---|---|---|---|
| 3,703,718 | 11/1972 | Berman | 340/567 |
| 3,928,843 | 12/1975 | Sprout et al. | 340/567 |
| 4,119,949 | 10/1978 | Lindgren | 340/600 |

*Primary Examiner*—Glen R. Swann, III

*Attorney, Agent, or Firm*—Laubscher & Laubscher

[57] ABSTRACT

Radiation detection apparatus is disclosed including a first detector (6) for detecting radiation at a wavelength which is preferably in the infra-red region, and a device for sensing the presence of an obturating element (11), which element acts to prevent operation of the first detector. The sensing means includes a transmitter (14) which transmits a signal at a second wavelength, and a second detector (15) responsive to and arranged to receive the signal in the presence of the obturating element, preferably by reflection of the signal from the element. An alarm (10) may be activated in response to detection of radiation or of the transmitted signal.

9 Claims, 3 Drawing Figures

PASSIVE INFRARED INTRUDER DETECTION SYSTEM

BACKGROUND OF THE INVENTION

This invention relates to radiation detection apparatus and will be described particularly with reference to pyroelectric passive infra-red intruder detection apparatus, that is, to apparatus responsive to infra-red radiation emitted by an unauthorised entrant into a space at a time when the space should be empty.

Such apparatus works on the principle that a change in infra-red radiation within its field of view is detected by the apparatus. The change in detected radiation produces an electrical signal which is amplified and filtered before being applied to a level detector circuit which operates an alarm. The detecting element may be at the focal point of a concave parabolic or spherical mirror which will provide a single zone having a sensitivity with strongly directional characteristics. Alternatively, the detecting element may be located at the focal point of an array of mirrors which can conveniently be arranged to produce a number of widely spaced radial zones of sensitivity. If these zones are arranged suitably, a large space can be covered by one detecting element.

A disadvantage of both these systems is that their zones of sensitivity can be partially or totally obscured by placing thermally opaque material over their apertures. Such material severely attenuates radiation in the range of wavelengths of interest, which range is typically between 4 and 20 microns and so approximately centred on 10 microns wavelength. If this is done, any change in radiation caused by an intruder will not be detected and the alarm will not be activated. This aspect places a serious limitation on the use of passive infra-red detectors for security purposes.

SUMMARY OF THE INVENTION

The present invention relates to radiation detection apparatus comprising first detecting means for detecting radiation at a first wavelength, first indicating means responsive to said first detecting means, characterized in that means for sensing the presence of an obturating element preventing the operation of said first detecting means are provided, said sensing means comprising transmitting means for transmitting a signal at a second wavelength, second detecting means responsive to the signal at the second wavelength in the presence of the obturating element, and second indicating means responsive to said second detecting means.

In the preferred embodiment, the first detecting means is arranged to be sensitive to infra-red radiation at between 4 and 20 microns. The transmitting and second detecting means are so disposed that the detecting means will only detect the transmitted signal if the signal is reflected from an obturating element. Preferably, this is achieved using a single concave spherical or parabolic mirror for not only the transmitted signal but also for the detected radiation. In order to reduce interaction between the two detecting means, a different wavelength is chosen for the second detecting means which falls outside the range of sensitivity of the first detecting means but which preferably is also within the infra-red region. Preferably, to further reduce interaction, the transmitted signal at the second wavelength is pulsed at a certain frequency and the apparatus is arranged to reject detected radiation not pulsed at that frequency. The two indicating means may include separate alarm devices one to form the conventional intrusion alarm, and the other an anti-tamper alarm.

Alternatively both the detecting circuits may be connected to a single alarm device for operation in either circumstance.

An alternative to the single mirror arrangement is to use an array of mirrors for producing a number of zones of sensitivity, and in this case the array may be used for focussing both the transmitted signal and the detected radiation in a similar fashion to that described above.

BRIEF DESCRIPTION OF THE DRAWINGS

In order that the invention be more readily understood, an embodiment thereof will now be described, by way of example, with reference to the accompanying drawings, in which.

DETAILED DESCRIPTION

Figure 1:
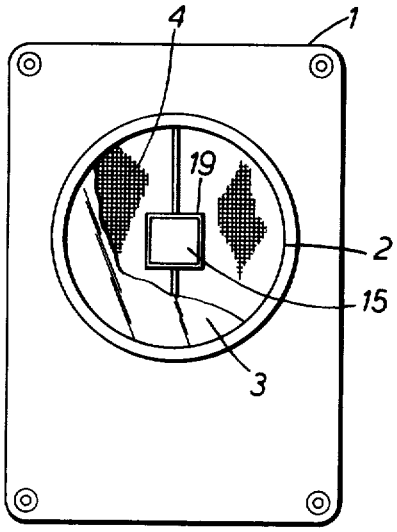
FIG. 1 is a partially cut-away front elevational view of an infra-red detector.
Figure 2:
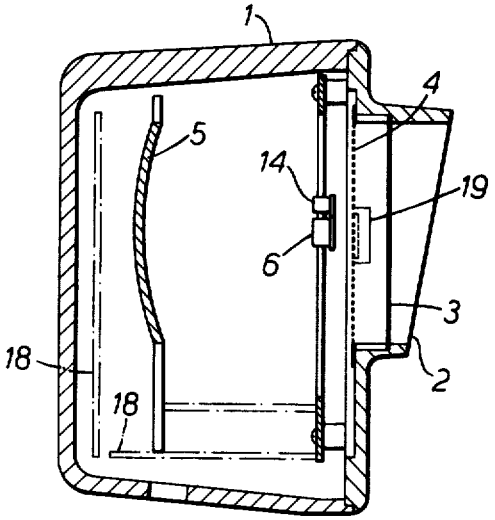
FIG. 2 is a side elevational sectional view of the detector of FIG. 1.

Referring to FIGS. 1 and 2, there is shown a housing 1 of an infra-red detector which substantially encloses and protects the internal apparatus from exterior stimuli except through an opening or window 2. The window 2 is covered by an infra-red transparent material 3 (shown partially cut-away) which is conveniently made of a polymer film to provide physical protection to the apparatus yet allow transmission of radiation at the wavelengths of interest. Further through the opening, there is provided a screening mesh 4 also shown partially cut-away in FIG. 1. At the rear of the housing there is positioned a concave mirror 5 arranged to focus substantially parallel radiation entering through the opening 2 and impingeing thereupon. The mirror 5 may be of parabolic or spherical configuration according to convenience. At the focal point of the mirror 5, there is positioned an infra-red detecting element 6.

Figure 3:
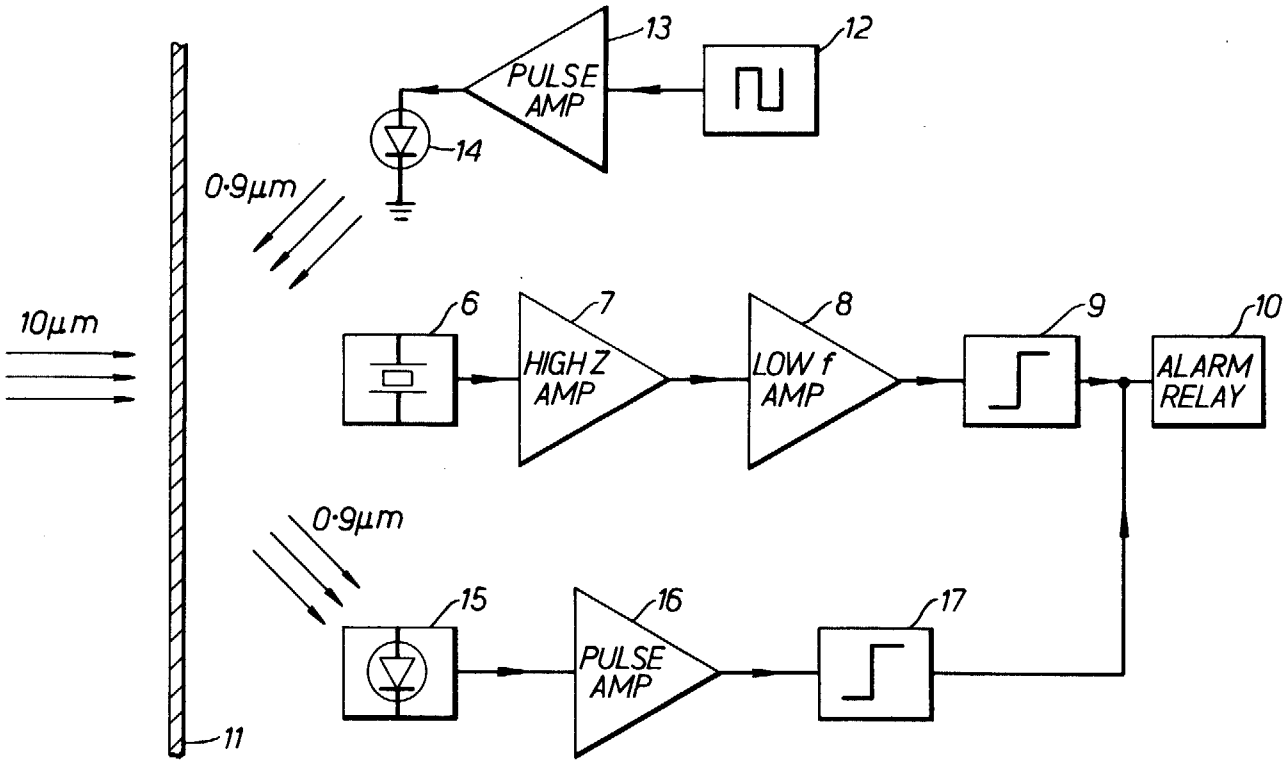
FIG. 3 is a block diagram of the circuit of the detector shown in FIGS. 1 and 2.

In operation, the presence of an intruder causes infra-red radiation to enter the housing through the opening 2 and to be reflected and focussed by the mirror 5 on to the detecting element 6. FIG. 3 shows a circuit which may be used with the above-described detector. The detecting element 6 converts a change of incident radiation into an electrical signal which is fed to the input of a high impedance amplifier 7. The amplified signal is fed through a low frequency amplifier 8 to a voltage level detector 9. A sufficiently large change in the level of incident radiation of the correct wavelength produces a change in the potential level of detector 6 to cause the level detector 9 to activate the alarm relay 10, so producing a warning of intrusion.

However, as stated above, the positioning of an obturating element, such as a screen of thermally opaque material 11 will drastically reduce or totally obscure the radiation incident on the infra-red detecting element, and thus an alarm indication may not be obtained.

A pulse generator 12 produces pulses of a fixed frequency which are amplified by a pulse amplifier 13 and fed to a radiation emitting diode 14. This diode 14 is chosen to emit radiation of a different wavelength to that at which the detecting element 6 is sensitive. A gallium arsenide diode, emitting radiation of about 0.9 microns wavelength is suitable as wavelengths emitted by the human body and hence at which the detecting element 6 is chosen to be sensitive are centred on about 10 microns.

Under normal conditions, the diode 14 emits radiation into the environment in a series of pulses according to the frequency of the generator 12, and this radiation has no further effect on the apparatus. However, if the thermally opaque screen 11 is placed in front of the detector to obstruct the alarm apparatus, a proportion of the pulsed radiation 14 is reflected from the screen 11 and on to a second detecting element which may conveniently be a radiation sensitive diode 15. This radiation gives rise to a pulsed electrical signal which is amplified by a pulse amplifier 16. The pulse amplifier 16 is preferably arranged to have strong rejection of frequencies below that of the pulse frequency thus minimizing interaction arising from the sensitivity of the detecting element 15 to other spurious radiation. The output of the amplifier 16 is fed to a second level detector 17, which upon receiving a sufficiently strong signal, activates the alarm relay 10 to produce a warning of attempted obscuring of the detector.

Referring back to FIGS. 1 and 2, the electrical apparatus is conveniently positioned on printed circuit boards 18 within the housing 1. The infra-red emitting diode 14 is positioned close to the detecting element 6. This means that since it is very close to the focal point of the mirror 5, its pulsed radiation will be reflected back by the mirror through the opening 2 as an approximately parallel straight beam. If a thermally opaque screen is positioned in front of the opening 2, a proportion of this pulsed radiation will be reflected back and onto the second detecting element 15. The detecting element 15 is conveniently positioned on the screening mesh 4 and has a shield 19 surrounding each side of it to prevent pulsed radiation being reflected spuriously, possibly from the interior of the housing, on to the element and providing a false alarm indication.

FIG. 3 shows the two voltage level detectors 9 and 17 of each infra-red circuit connected to one alarm relay 10. However, if preferred, these may be connected to separate relays to provide one main alarm with a separate anti-tamper alarm having a separate circuit.

The use of the low frequency amplifier 8 sensitive to slow changes in incident infra-red radiation, in combination with the pulse amplifier 16 sensitive to frequencies above that of the pulse generator 12 minimize the possibility of any interaction between the two systems which may arise, for example, as a result of the detecting element 6 reacting to the pulsed radiation from the diode 14. The interaction is also reduced by using a wavelength (e.g. 0.9 microns as above) of pulsed radiation suitably different to the wavelengths likely to be produced by an intruder (centred on 10 microns) to which the detecting element 6 is chosen to be sensitive.

In practice it may be found that interaction is sufficiently minimize by using two wavelengths sufficiently different so that pulsing of the radiation is not necessary. However, for satisfactory performance over a wide range of ambient conditions, it is preferable that the radiation should be pulsed and the detecting circuit arranged to be sensitive at that pulse frequency.

The apparatus described above utilizes a concave mirror for both focussing the radiation emitted from the exterior on to the first detecting element and also for reflecting the pulsed radiation into the zone to be protected. However, where a number of widely spaced zones are to be covered, as described above, by using an array of mirrors, the same principle of operation can be used whereby the pulsed radiation is emitted into the number of zones by reflection from the array of mirrors. A suitably mounted detecting element will then respond to pulsed radiation reflected from a thermally opqaue screen in a similar manner to that described above.

I claim:

1. Radiation detection apparatus, comprising (a) first detector means (6–9) for detecting radiation of a first wavelength emitted by a radiation source;

(b) indicating means (10) connected with said first detector means and operable when the detected radiation exceeds a first level; and (c) reflection-responsive means operable when an obturating element (11) is positioned between the radiation source and said first detector means, said second indicating means including (1) transmitter means (14) adjacent said first detector means for transmitting a signal of a second wavelength in the general direction of the radiation source; and (2) second detector means (15–17) adjacent said first detector means for detecting the signal of second wavelength when reflected from said obturating element (11) for operating an indicating means when the level of the reflected signal received by said second detector means exceeds a second level.

2. Apparatus as defined in claim 1, wherein said transmitter means further includes means (5) collimating said signal of second wavelength as at least one substantially parallel beam.

3. Apparatus as defined in claim 2, wherein said collimating means (5) is arranged to focus radiation at the first wavelength onto said first detecting means.

4. Apparatus as defined in claim 3, wherein said collimating means comprises a concave spherical mirror.

5. Apparatus as defined in claim 3, wherein said collimating means comprises a concave parabolic mirror.

6. Apparatus as defined in claim 3, wherein said collimating means comprises an array of mirrors for emitting the second wavelength signal as a plurality of substantially parallel beams.

7. Apparatus as defined in claim 1, wherein said transmitter means includes means (12, 13) for causing said signal of second wavelength to be pulsed at a constant frequency, said second detector means (15) being responsive to the signal pulsed at that frequency.

8. Apparatus as defined in claim 1, wherein said transmitter means is operable to transmit radiation of substantially 0.9 microns wavelength.

9. Apparatus as defined in claim 1, wherein said first detector means and said reflection-responsive means operate the same indicating means.

* * * * *